US007520688B2

(12) United States Patent
Kayser et al.

(10) Patent No.: US 7,520,688 B2
(45) Date of Patent: Apr. 21, 2009

(54) MOUNTING ARRANGEMENT AND SUPPORT STAND FOR PRINT FEED MECHANISMS

(75) Inventors: David E. Kayser, Middlebury, CT (US); Richard A. Sloan, Jr., Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 340 days.

(21) Appl. No.: 11/511,845

(22) Filed: Aug. 29, 2006

(65) Prior Publication Data

US 2008/0056801 A1 Mar. 6, 2008

(51) Int. Cl.
*B41J 11/58* (2006.01)
*B65H 1/00* (2006.01)
*B65H 1/06* (2006.01)

(52) U.S. Cl. ..... 400/624; 400/578; 400/613; 400/691; 271/223; 248/676

(58) Field of Classification Search ..... 400/578, 400/613, 624, 691; 271/278, 223–224; 248/674, 248/676; 347/108
See application file for complete search history.

(56) References Cited

U.S. PATENT DOCUMENTS 4,544,065 A * 10/1985 Mueller ..... 211/50
4,707,156 A * 11/1987 Clark ..... 400/613.2
5,099,996 A * 3/1992 Vallis ..... 206/449
5,499,043 A * 3/1996 Osaka ..... 347/108

* cited by examiner

*Primary Examiner*—Daniel J Colilla
*Assistant Examiner*—Marissa L Ferguson-Samreth
(74) *Attorney, Agent, or Firm*—Brian A. Collins; Angelo N. Chaclas

(57) ABSTRACT

A mounting arrangement and/or stand for supporting a print feed mechanism relative to a printer. The mounting arrangement includes first and second support members defining first and second mating surfaces, respectively. The first support member is adapted to support the print feed mechanism and the second support member is adapted to support the first support member. Furthermore, the first and second mating surfaces define a mating interface or plane which is inclined relative to a horizontal plane. The relative position of the first and second support members is maintained by a means for coupling the first and second segments along the inclined mating plane. The coupling means is, furthermore, operative to selectively position the first support member relative to the second support member so as to separate the print feed mechanism segment from the printer by a fixed separation distance. The selected separation distance accommodates print media which varies in length while the inclined mating plane maintains the inclination angle of the print media at any selected separation distance.

21 Claims, 4 Drawing Sheets

MOUNTING ARRANGEMENT AND SUPPORT STAND FOR PRINT FEED MECHANISMS

TECHNICAL FIELD

This invention relates to print feed mechanisms and, more particularly, to a new and useful mounting arrangement therefor which facilitates variable size media to a printing apparatus.

BACKGROUND ART

Print feed mechanisms or modules are commonly employed to supply printers with various size media for printing. One such print feed mechanism, to which the present invention is directed, is a feeder for supplying in-line printers with envelopes used in the fabrication of mailpieces. Generally, the print media/envelopes are stacked in register and angled downwardly toward an entrance or input area which typically includes a drive nip for conveying singulated envelopes to the print head(s) of the printer. The media/envelopes are disposed at an inclination angle of about twenty-five degrees (25°) to allow gravity to assist in the singulation and delivery of the media/envelopes.

Inasmuch as the printer may be adapted to print on envelopes of various size and thickness, it is common to employ multiple print feeders/cartridges to accommodate the large variety of available media/envelopes. That is, to expedite a variety of print jobs (some of the print jobs requiring a different size/shape envelope to accommodate a variation in mailpiece content material), printers commonly include an interface, i.e., between the input area and the output of the media/envelope feeder, which facilitates the rapid connect/disconnect of a variety of print feed mechanisms—each having a ready supply of media/envelopes available for printing.

Various efforts have been made to develop print feed mechanisms capable of singulating/delivering envelopes having a variety of sizes, shapes and/or thickness dimension. Of the various geometric design considerations, the inclination angle for mailpiece delivery is, perhaps, one of the most important design criterion to address/maintain. To accommodate/maintain the inclination angle while, at the same time, changing the configuration of the envelops, e.g., the size of envelope, various solutions have been attempted, ranging from the practical to the more complex. One of the practical solutions typically includes a means for lifting the base of the print feeder, e.g., using short blocks of wood to change the elevation of the print feeder. By changing its height, the feeder can be spaced-apart from the printer to accommodate larger envelops while maintaining the inclination angle to the receiving or entrance area of the printer. Yet other solutions have included a complex base mechanism which includes a telescoping base having a tilting head for supporting an envelope stack. The telescoping base enables elevation adjustment while the tilting head may be adjusted to accommodate a range of acceptable inclination angles.

While the foregoing solutions represent viable methods/mechanisms to accommodate the delivery of various size/shape/thickness envelopes, such methods/mechanisms are either unreliable, inexact or costly to implement.

A need, therefore, exists for an effective, accurate and low cost mounting arrangement/support stand for delivering/feeding media to a print apparatus.

BRIEF DESCRIPTION OF THE DRAWINGS

The accompanying drawings illustrate presently preferred embodiments of the invention and, together with the general description given above and the detailed description given below serve to explain the principles of the invention. As shown throughout the drawings, like reference numerals designate like or corresponding parts.

SUMMARY OF THE INVENTION

A mounting arrangement and/or stand is provided for supporting a print feed mechanism relative to a printer. The mounting arrangement includes first and second support members defining first and second mating surfaces, respectively. The first support member is adapted to support the print feed mechanism and the second support member is adapted to support the first support member. Furthermore, the first and second mating surfaces define a mating interface or plane which is inclined relative to a horizontal plane. The relative position of the first and second support members is maintained by a means for coupling the first and second segments along the inclined mating plane. The coupling means is, furthermore, operative to selectively position the first support member relative to the second support member so as to separate the print feed mechanism segment from the printer by a fixed separation distance. The selected separation distance accommodates print media which varies in length while the inclined mating plane maintains the inclination angle of the print media at any selected separation distance.

DETAILED DESCRIPTION

The present invention is described in the context of a stand for a supporting a print feed mechanism relative to a printer. The stand defines a mounting arrangement for accommodating variable length print media stacked within and delivered by the print feed mechanism. While the invention is described as a dedicated and separate unit for supporting the print feed mechanism, it should be appreciated that the print feed mechanism may be configured or adapted to include a novel mounting arrangement incorporated within the support stand. Hence, the invention may be viewed as either a support stand or a mounting arrangement, depending upon which configuration is most efficient, i.e., structurally or fiscally.

In the described embodiment, the print feed mechanism delivers mailpiece envelopes to an in-line printer having predefined zones for printing mailpiece addresses, return address information and postage indicia. While the invention is described in the context of creating mailpieces, it should be appreciated that the invention is applicable to print feed mechanisms for any print media and for any printer, whether such printer is specifically designed to print mailpiece envelopes, conventional correspondence or other printed material.

Figure 1:
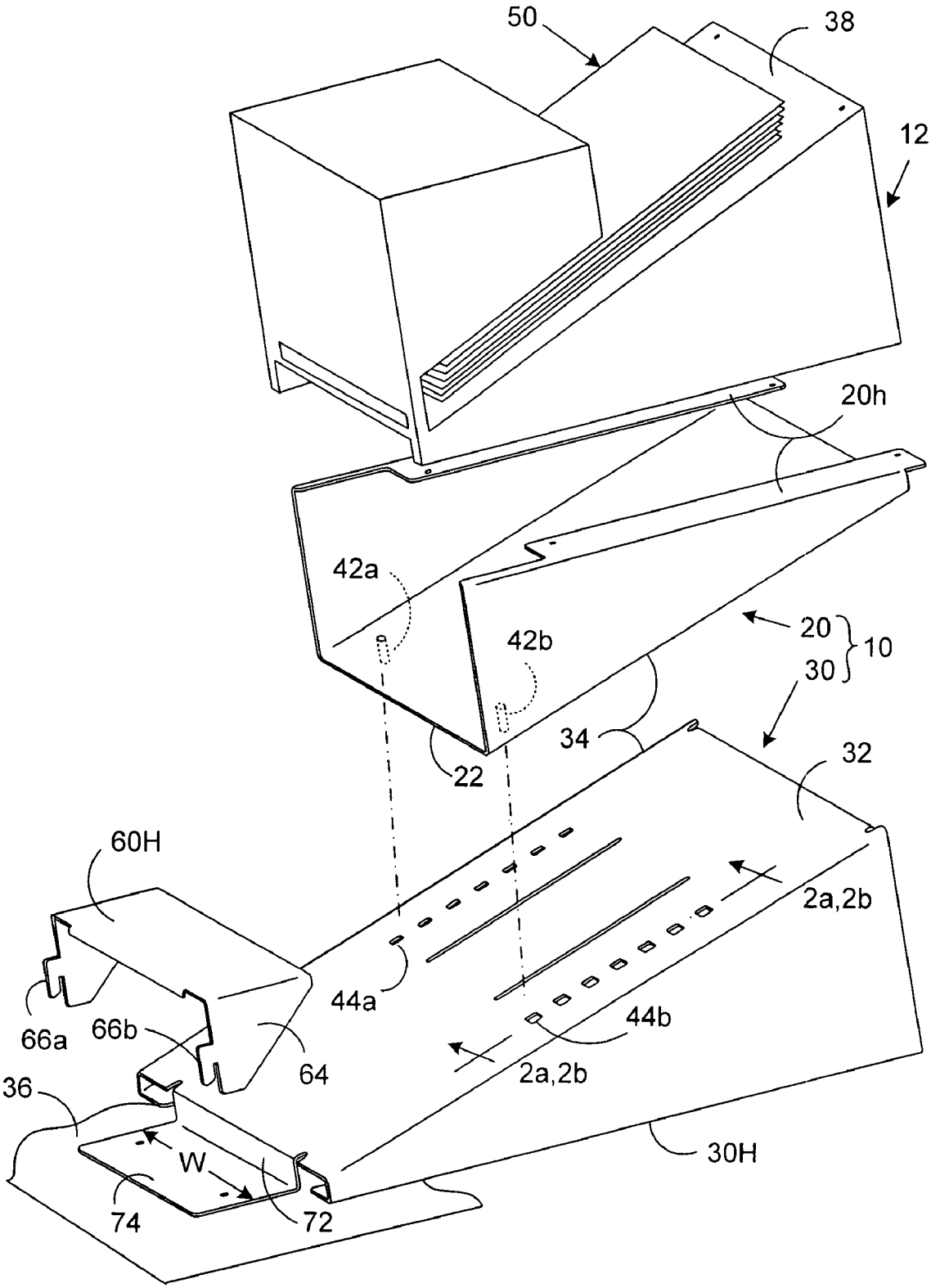
FIG. 1 is an exploded perspective of a stand for supporting a print feed mechanism according to the present invention including a first segment adapted to support the print feed mechanism, a second segment adapted to support the first support member and a means for coupling the first and second segments along a mating interface or plane which is inclined relative to a horizontal plane.

In FIG. 1, an exploded view is shown of a support stand 10 according to the present invention adapted to support a print feed mechanism 12 relative to a printer (not shown). The stand 10 includes a first support member or segment 20, a second support member or segment 30 and a mount/mechanical interlock 40 for coupling the first and second support members 20, 30 along an inclined mating interface or plane. More specifically, the first support member 20 is adapted to support the print feed mechanism 12 and includes a first mating surface 22. The second support member 30 is adapted to support the first support member 20 and includes a second mating surface 32. The mating surfaces 22, 32 define a mating interface or plane 34 which is inclined relative to a horizontal plane 36. In the preferred embodiment, the inclined plane 34 is substantially parallel to a media support surface 38 upon which print media 50 is stacked for delivery to a printer (also not shown).

Figure 2A:
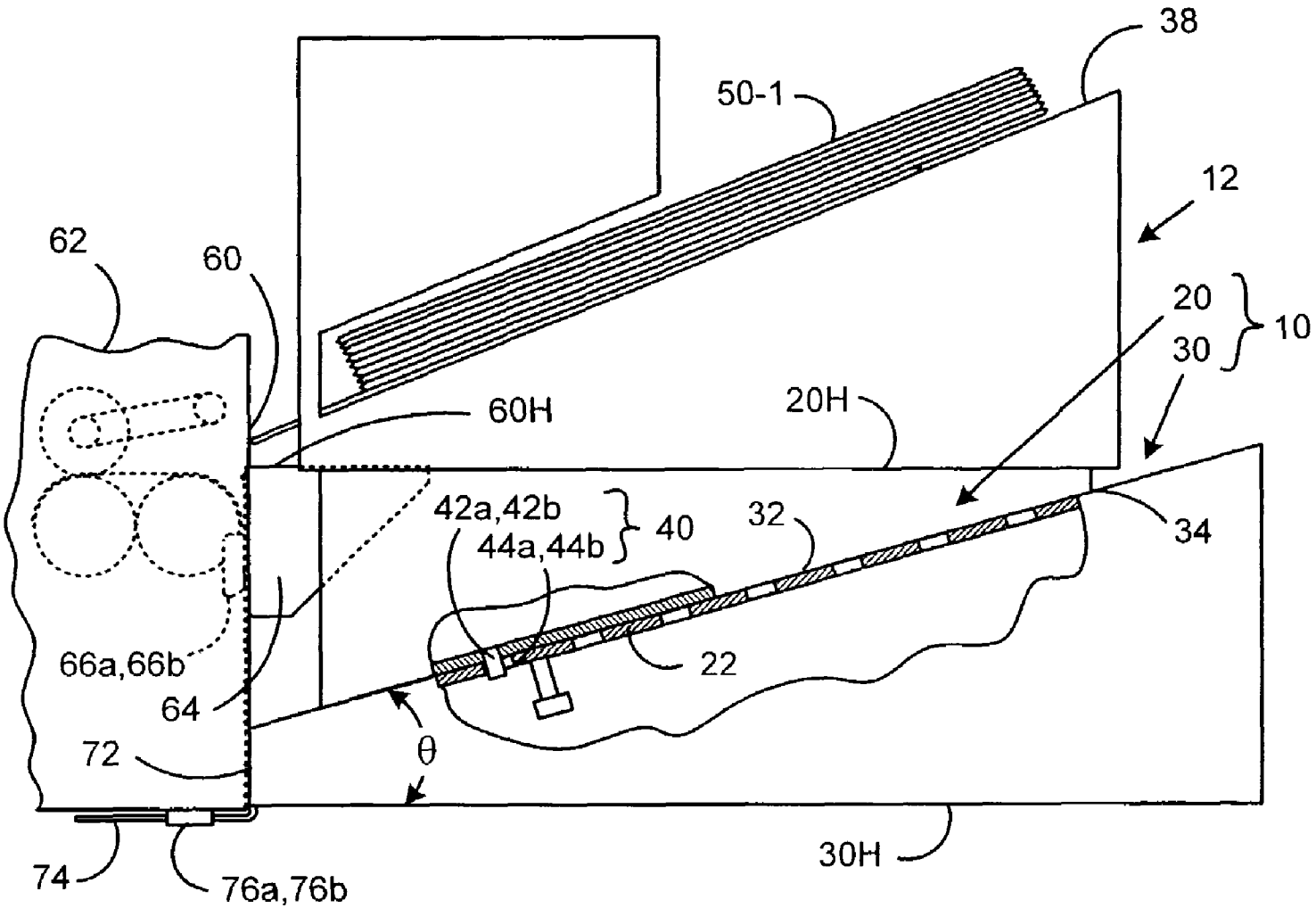
FIG. 2*a* is a sectional view taken substantially along line 2*a*-2*a* of FIG. 1 wherein the support stand disposed in a first operational position for delivering print media of a first length dimension to the entrance portal of an in-line printer.
Figure 2B:
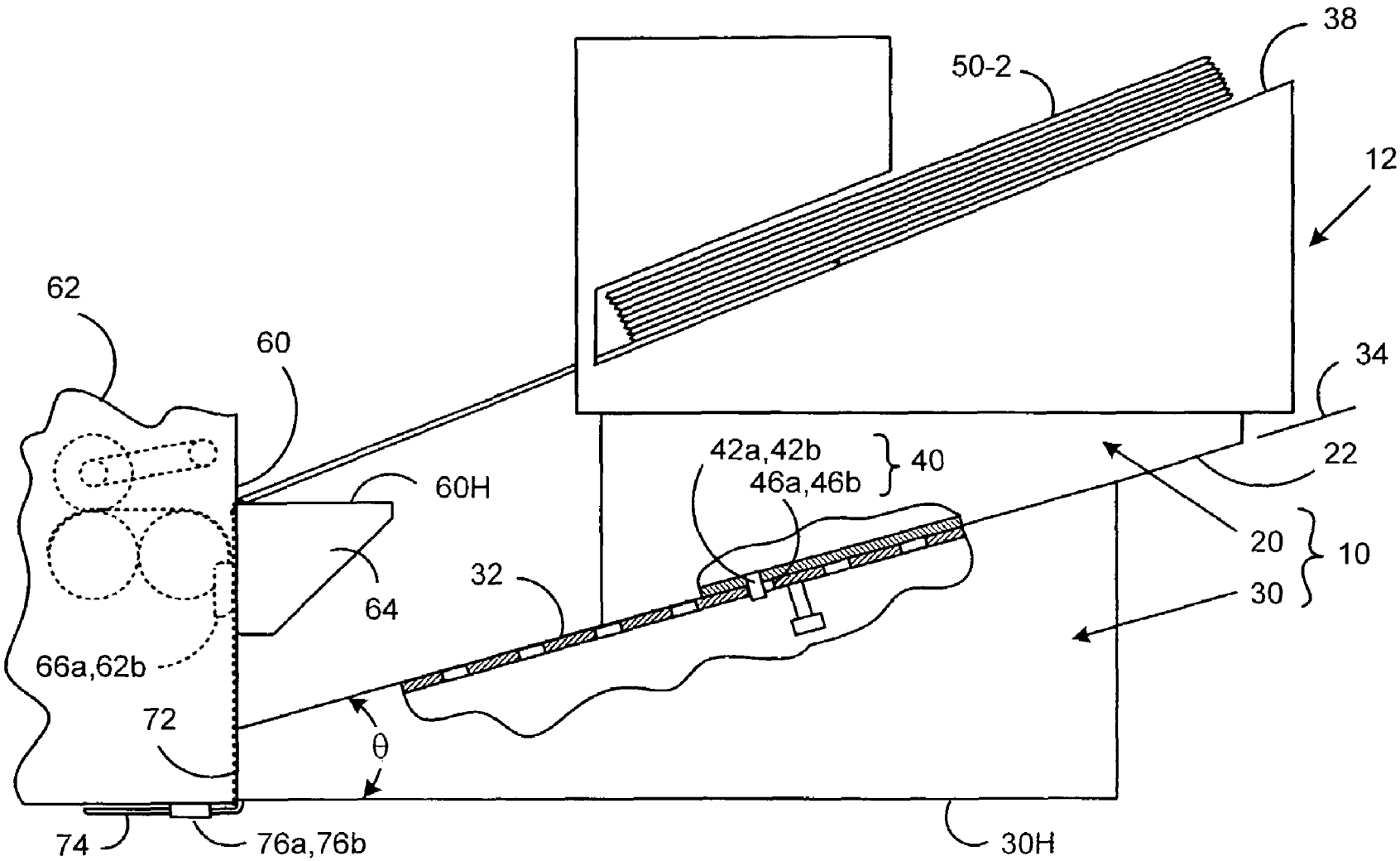
FIG. 2*b* is a sectional view taken substantially along line 2*b*-2*b* of FIG. 1 wherein the support stand disposed in a second operational position for delivering print media of a second length dimension, longer than the first, to the entrance portal of the in-line printer.

In FIGS. 1, 2*a*, and 2*b*, the mechanical interlock 40 couples the support members 20, 30 along the inclined plane and is operative to selectively position the first and second support members 20, 30 to separate the print feed mechanism 12 from the printer by a fixed separation distance. In the described embodiment the mechanical interlock 40 includes a pair of mounting pins 42*a*, 42*b* protruding orthogonally from one of the first and second mating surfaces 22, 32 and a plurality of aligned apertures 44*a*, 44*b* (see FIGS. 2*a* and 2*b*) formed in the other one of the first and second mating surfaces 22, 32, and wherein the pair of mounting pins 42*a*, 42*b* engage the aligned apertures 44*a*, 44*b* to align and position the first and second segments 20, 30 along the mating plane 34.

While the mechanical interlock 40 is shown as a pair of protruding pins 42*a*, 42*b* engaging pairs of apertures 44*a*, 44*b*, 46*a*, 46*b*, it should be appreciated that any adjustable or reconfigurable coupling means may be employed to join/mate the first and second support members 20, 30. For example, a guide track having a plurality of detents/alignment apertures may be employed for displacing the support members 20, 30 along the mating plane 34 and rigidly affixing the relative position of the support members 20, 30 to displace the first support member 20 a fixed separation distance from the printer.

In FIG. 2*a*, print media 50-1 of a first length dimension is stacked upon the print media support surface 38 of the print feed mechanism 12. The first support member 20 is shown in a first operational position for delivering the print media 50-1 to an entrance portal 60 of a printer 62. Moreover, the alignment pins 42*a*, 42*b* engage a first pair of apertures 44*a*, 44*b* to fix the position of the first support member 20 relative to the second support member 30. The print media 50-1 is bottom fed and the angle of inclination provides a gravity assist for supplying the print media 50-1.

In FIG. 2*b*, print media 50-2 of a second length, longer than the first, is stacked upon the inclined support surface 38 of the same print feed mechanism 12. In this view, it will be noted that the first support member 20 has been displaced along the mating plane 34 to a second operational position to accommodate the greater length of the print media 50-2. More specifically, the mechanical interlock 40 has been reconfigured such that the alignment pins 42*a*, 42*b* engage a second pair of apertures 46*a*, 46*b*. While the separation distance between the first support member 20 and the entrance portal 60 has increased or grown from the first to second operational positions, the inclination angle θ has been maintained by the mating interface or plane 34, i.e., by the parallel relationship between the inclined support surface 38 and the inclined plane 34. In the described embodiment the inclination angle θ is within a range of about twenty (20°) to thirty (30°) degrees to assist in the singulation and delivery of the print media 50-1, 50-2.

In FIGS. 2*a* and 2*b*, a media guide 64 may be employed in combination with the printer, proximal to (e.g., directly below) the entrance portal 60, to guide the print media 50-1, 50-2 into the printer. In the described embodiment, the media guide 64 is detachably mounted to the printer via mounting brackets 66*a*, 66*b* which engage vertical slots (not shown) in a vertical face of the printer. Furthermore, the media guide 64 extends outwardly from the printer, i.e., defining a substantially horizontal guide surface to guide the print media 50-1, 50-2 to the entrance portal 60.

Figure 3:
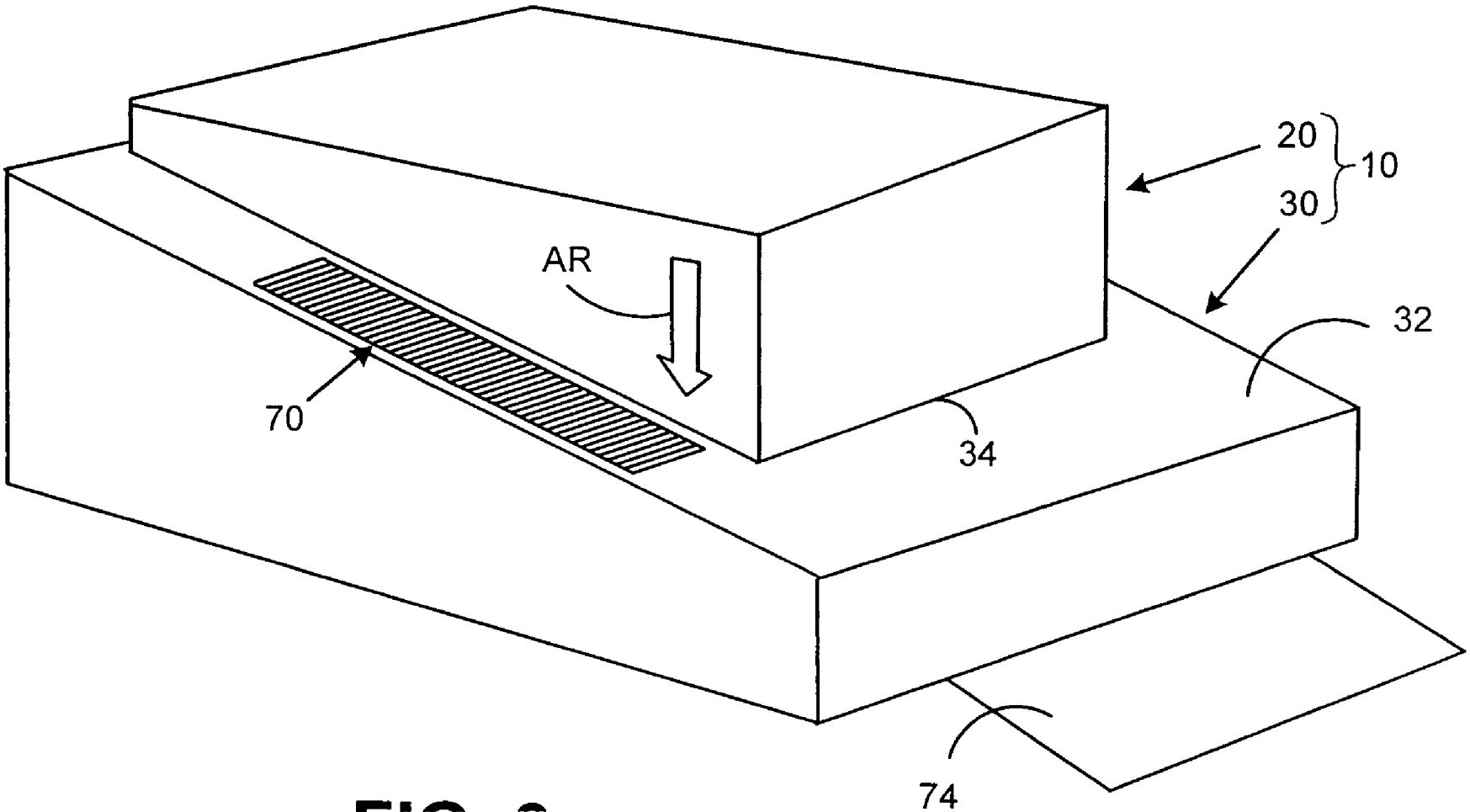
FIG. 3 is a perspective view of the support stand including indicia disposed along the mating interface for providing a visual cue to an operator concerning the prescribed positions of the first and second segments which correspond to various lengths of print media.

In FIG. 3, an indicating tape, alignment indicia or symbology 70 may be employed adjacent the mating interface or plane 34 of the first and second segments 20, 30 to provide a visual cue to an operator concerning the relative position of the segments 20 30. That is, the alignment indicia 70 provide an indication, an arrow AR, regarding the relative position of the segments 20, 30 to accommodate print media of varying size or length. The indicia 70 may include a plurality of settings for accommodating print media which may vary in ½ inch increments from, for example, five (5) inches in length to twelve (12) inches.

Returning to the exploded perspective view shown in FIG. 1, the support stand 10 interfaces with the printer so as to avoid or mitigate misalignment or skewing of the print feed mechanism 12. More specifically, the second support member or segment 30 may include a vertical registration surface 72 for abutting a vertical wall of the printer (not shown in FIG. 1) to accurately position the print feed mechanism 12 relative to the printer. Additionally, the second support member 30 may include an alignment tongue 74 protruding from a forward end thereof to engage a slot-shaped opening (not shown) in the printer. The alignment tongue 74 is operative, alone or in combination with the vertical registration surface 72, to maintain lateral alignment of the print feed mechanism 12 relative to the printer. In one embodiment of the invention and referring to additionally to FIGS. 2*a* and 2*b*, the alignment tongue 74 may slide under the printer 62 for being disposed between and abutting a pair of feet 76*a*, 76*b* which support the printer 62. In this embodiment, the width dimension W (see FIG. 1) of the alignment tongue 74 is substantially equal to the feet separation distance to prevent substantial play or movement between the printer feet 76*a*, 76*b*.

While the first and second support members or segments 20, 30 are shown as a pair of separate wedge-shaped elements, each having horizontal surfaces 20H, 30H for supporting the print feed mechanism 12 along a horizontal plane, it should be appreciated that either or both support members 20, 30 may be integrated with the underside of the print feed mechanism 12 or with another support surface defined by the printer or a separate table support.

In summary, the present invention provides a novel mounting arrangement/stand 10 for supporting a print feed mechanism 12 relative to a printer. The mounting arrangement/stand 10 accommodates the use of a variable size/shape print media while maintaining the inclination angle θ of the print feed mechanism 12. Furthermore, the invention provides a reliable, accurate and low cost mounting arrangement/support stand 10 for interfacing a print feed mechanism 12 with a printer. Moreover, the mounting arrangement/support stand 10 may be adapted for use with various print feed mechanisms and print systems.

Although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. A stand for supporting a print feed mechanism relative to a printer, the print feed mechanism delivering print media to the printer, the stand comprising;

a first segment defining a first mating surface and adapted to support the print feed mechanism;

a second segment defining a second mating surface and adapted to support the first segment;

the first and second mating surfaces defining a mating interface which is inclined relative to a horizontal plane; and a mechanical interlock coupling the first and second segments along the inclined mating interface and operative to selectively position the first segment relative to the second segment so as to separate the first segment from the printer by a fixed separation distance;

wherein the selected separation distance accommodates print media which varies in length and the inclined mating interface maintains the inclination angle of the print media at any selected separation distance.

2. The stand according to claim 1 wherein the first and second segments define stand and feeder support surfaces, respectively, and wherein the support surfaces lie in a substantially horizontal plane.

3. The stand according to claim 1 wherein the print feed mechanism includes a print media support surface defining an inclination angle, and wherein the inclined mating interface is substantially parallel to the inclination angle.

4. The stand according to claim 1 further comprising a media guide detachably mounting to the printer proximal to the entrance portal for accepting print media and defining a guide surface extending outwardly from the printer to guide print media to the entrance portal.

5. The stand according to claim 1 wherein the second segment defines a vertical registration surface for abutting a vertical wall of the printer, the registration surface, in combination with the printer wall, operative to accurately position the print feed mechanism relative to the printer.

6. The stand according to claim 1 wherein the second segment defines a alignment tongue protruding from a forward end thereof to engage a slot-shaped opening in the printer and operative to maintain lateral alignment of the print feed mechanism relative to the printer.

7. The stand according to claim 1 wherein the printer is supported by feet disposed along an underside surface of the printer, wherein at least one pair of feet define a feet separation distance therebetween and wherein the alignment tongue defines a width dimension substantially equal to the feet separation distance such that the alignment tongue engages the feet to maintain lateral alignment of the print feed mechanism.

8. The stand according to claim 1 wherein the mechanical interlock includes a pair of mounting pins protruding orthogonally from one of the first and second mating surfaces and a plurality of aligned apertures formed in the other one of the first and second mating surfaces, and wherein the pair of mounting pins engage the aligned apertures to align and position the first and second segments along the mating interface.

9. The stand according to claim 1 further comprising alignment indicia disposed along the mating interface of the first and second segments, the alignment indicia operative to provide a visual cue to an operator concerning the relative position of the segments when feeding print media of a predetermined size to the printer.

10. The stand according to claim 1 further comprising a plurality of suction cups disposed along an underside surface of the first segment for securing the position of the stand relative to the underlying support structure.

11. An adjustable mounting arrangement for a print feed mechanism comprising;

a first support member defining a first mating surface and adapted to support the print feed mechanism;

a second support member defining a second mating surface and adapted to support the first support member;

the first and second support members mating along a plane which is inclined relative to a horizontal plane; and a means for coupling the first and second support members along the inclined plane and selectively positioning the first and second support members to separate the print feed mechanism from a printer by a fixed separation distance.

12. The adjustable mounting arrangement according to claim 11 wherein the print feed mechanism includes a print media support surface defining an inclination angle, and wherein the inclined plane is substantially parallel to the inclination angle.

13. The adjustable mounting arrangement according to claim 11 wherein the coupling means includes a pair of mounting pins protruding orthogonally from one of the first and second mating surfaces and a plurality of aligned apertures formed in the other one of the first and second mating surfaces, and wherein the pair of mounting pins engage a pair of aligned apertures to align and position the first and second support members along the inclined plane.

14. The adjustable mounting arrangement according to claim 11 further comprising alignment indicia disposed along the mating surfaces of the first and second support members, the alignment indicia operative to provide a visual cue to an operator concerning the relative position of the mounting structures when feeding print media of a predetermined size to the printer.

15. A structural interface for supporting a print feed mechanism relative to a printer and accommodating print media of variable length, the structural interface comprising:

a first support member defining a first mating surface and adapted to support the print feed mechanism;

a second support member defining a second mating surface and adapted to support the first support member;

the first and second support members detachably mating along a plane which is inclined relative to a horizontal plane;

a mechanical interlock coupling the first and second support members along the inclined mating plane and operative to selectively position the first support member relative to the second support member to separate the first support member from the printer by a fixed separation distance; and a media guide detachably mounting to the printer proximal to a entrance portal for accepting print media and defining a guide surface extending outwardly from the printer, wherein the selected separation distance accommodates print media which varies in length, the inclined mating interface maintains the inclination angle of the print media at any selected separation distance, and the media guide is operative to guide oversized print media to the entrance portal.

16. The structural interface according to claim 15 wherein the print feed mechanism includes a print media support surface defining an inclination angle, and wherein the inclined plane is substantially parallel to the inclination angle.

17. The structural interface according to claim 15 wherein the second support member defines a vertical registration surface for abutting a vertical wall of the printer, the registration surface, in combination with the printer wall, operative to accurately position the print feed mechanism relative to the printer.

18. The structural interface according to claim 15 wherein the second support member defines an alignment tongue protruding from a forward end thereof to engage a slot-shaped opening of the printer and operative to maintain lateral alignment of the print feed mechanism relative to the printer.

19. The structural interface according to claim 18 wherein the printer is supported by feet disposed along an underside surface thereof, wherein at least one pair of feet define a feet separation distance therebetween and wherein the alignment tongue defines a width dimension substantially equal to the feet separation distance such that the alignment tongue engages the feet to maintain lateral alignment of the print feed mechanism.

20. The structural interface according to claim 15 wherein the mechanical interlock includes a pair of mounting pins protruding orthogonally from one of the first and second mating surfaces and a plurality of aligned apertures formed in the other one of the first and second mating surfaces, and wherein the pair of mounting pins engage a pair of aligned apertures to align and position the first and second support members along the mating interface.

21. The structural interface according to claim 15 further comprising alignment indicia disposed along the mating interface of the first and second support members, the alignment indicia operative to provide a visual cue to an operator concerning the relative position of the support members when feeding print media of a predetermined size to the printer.

* * * * *